US010549206B1

(12) United States Patent
Nirwan

(10) Patent No.: US 10,549,206 B1
(45) Date of Patent: Feb. 4, 2020

(54) ASSEMBLED SLIDE

(71) Applicant: Crowntec (Jiang Xi) Sports Technology Co. Ltd., Jiujiang, Jiangxi Province (CN)

(72) Inventor: Soebagiyo Nirwan, Jiujiang (CN)

(73) Assignee: Crowntec (Jiang XI) Sports Technology Co. Ltd., Jiujiang, Jiangxi Province (CN)

( * ) Notice: Subject to any disclaimer, the term of this patent is extended or adjusted under 35 U.S.C. 154(b) by 0 days.

(21) Appl. No.: 16/296,649

(22) Filed: Mar. 8, 2019

(30) Foreign Application Priority Data

Jan. 28, 2019 (CN) ..... 2019 1 0079865

(51) Int. Cl.
*A63G 21/02* (2006.01)
*A63G 21/00* (2006.01)

(52) U.S. Cl.
CPC ..... *A63G 21/02* (2013.01)

(58) Field of Classification Search
CPC ..... A63G 21/00; A63G 21/02; A63G 21/04
USPC ..... 472/116–117, 128; 104/69, 70
See application file for complete search history.

(56) References Cited

U.S. PATENT DOCUMENTS 4,299,171 A * 11/1981 Larson ..... A63G 3/02 104/70
4,932,648 A * 6/1990 Ahrens ..... A63G 21/00 104/70
4,943,048 A * 7/1990 Hentges ..... A63G 21/00 182/49
8,651,970 B2 2/2014 Chen

* cited by examiner

*Primary Examiner* — Kien T Nguyen
(74) *Attorney, Agent, or Firm* — Muncy, Geissler, Olds & Lowe, P.C.

(57) ABSTRACT

An assembled slide is defined with a slide front side and a slide back side, comprises a head section, a connect section and a tail section. The head section is disposed with a first carrying portion at a head section first end facing the connect section, the connect section is disposed with a first lapping portion connected to the first carrying portion at a connect section first end facing the head section and a second carrying portion at a connect section second end facing the tail section, and the tail section is disposed with a second lapping portion connected to the second carrying portion at a tail section first end facing the connect section. The head section, connect section and tail section are respectively formed with at least one accommodating groove on an axis. At least one support rib is disposed in the at least one accommodating grooves.

9 Claims, 6 Drawing Sheets

ASSEMBLED SLIDE

FIELD OF THE INVENTION

The present invention relates to an assembled slide.

BACKGROUND OF THE INVENTION

The techniques of assembled slide can be referred to the disclosure in the U.S. Pat. No. 8,651,970. However, although the aforementioned patent discloses a detachable structure, a plurality of connecting members or engaging members are still needed to complete the assembly during assembling, resulting in cumbersome assembly procedures. In addition, although nowadays there are products of assembled slides available, they generally have the problems of large volume resulting in inconvenience in transporting them.

SUMMARY OF THE INVENTION

A main object of the present invention is to solve the problem of cumbersome assembling of the conventional assembled slides.

In order to achieve the above objective, the present invention provides an assembled slide being defined with a slide front side and a slide back side. The assembled slide is respectively disposed with a retaining wall on two sides of the slide front side. The assembled slide comprises a head section, a connect section and a tail section which are assembled in sequence. The head section is disposed with a first carrying portion at a head section first end facing the connect section, the connect section is disposed with a first lapping portion connected to the first carrying portion at a connect section first end facing the head section, the connect section is disposed with a second carrying portion at a connect section second end facing the tail section, and the tail section is disposed with a second lapping portion connected to the second carrying portion at a tail section first end facing the connect section. The head section, the connect section and the tail section are respectively formed with at least one accommodating groove on the slide back side, the accommodating grooves are located on an axis and are communicated sequentially, and the assembled slide comprises at least one support rib disposed in the accommodating grooves.

In one embodiment, the accommodating grooves are respectively located on at least two of the axes which are parallel to each other, the assembled slide comprises at least two of the support ribs, and each of the at least two support ribs is located on one of the at least two axes.

In one embodiment, the first carrying portion comprises two first connect plates respectively located at two sides of the head section first end, a first auxiliary support plate separated from the two first connect plates and located between the at least two axes, two first connect walls respectively extending from one of the first connect plates and serving as a part of one of the retaining walls, and two first protrusions respectively disposed on one of the first connect plates and extending to one of the first connect walls, the first lapping portion comprises a second connect plate connected to the two first connect plates and the first auxiliary support plate, and two first grooves disposed on the second connect plate and respectively assembled to one of the first protrusions.

In one embodiment, the second carrying portion comprises two third connect plates respectively located at two sides of the connect section second end, a second auxiliary support plate separated from the two third connect plates and located between the at least two axes, two second connect walls respectively extending from one of the third connect plates and serving as a part of one of the retaining walls, and two second protrusions respectively disposed on one of the third connect plates and extending to one of the second connect walls, the second lapping portion comprises a fourth connect plate connected to the two third connect plates and the second auxiliary support plate, and two second grooves disposed on the fourth connect plate and respectively assembled to one of the second protrusions.

In one embodiment, at least one of the head section and the tail section is formed with at least one support frame mounting groove on the slide back side.

In one embodiment, the first carrying portion comprises two first connect plates respectively located at two sides of the head section first end, two first connect walls respectively extending from one of the first connect plates and serving as a part of one of the retaining walls, and two first protrusions respectively disposed on one of the first connect plates and extending to one of the first connect walls. The first lapping portion comprises a second connect plate connected to the two first connect plates, and two first grooves disposed on the second connect plate and respectively assembled to one of the first protrusions.

In one embodiment, the second carrying portion comprises two third connect plates respectively located at two sides of the connect section second end, two second connect walls respectively extending from one of the third connect plates and serving as a part of one of the retaining walls, and two second protrusions respectively disposed on one of the third connect plates and extending to one of the second connect walls. The second lapping portion comprises a fourth connect plate connected to the two third connect plates, and two second grooves disposed on the fourth connect plate and respectively assembled to one of the second protrusions.

In one embodiment, the head section comprises a first engaging tab disposed at a head section second end opposite to the connect section, and the tail section comprises a second engaging tab disposed at a tail section second end opposite to the connect section.

Through the foregoing implementation of the present invention, the assembled slide of the present invention comprises the following advantages compared with the prior art. The assembled slide of the present invention solves the problem that the conventional slides cannot be disassembled, resulting in excessively large volume in transporting them. Furthermore, the components of the assembled slide of the present invention are implemented by lap joint to simplify the use of reinforcing sheets, that is, the assembly of the assembled slide is quick and simple.

DETAILED DESCRIPTION OF THE PREFERRED EMBODIMENTS

Figure 1:
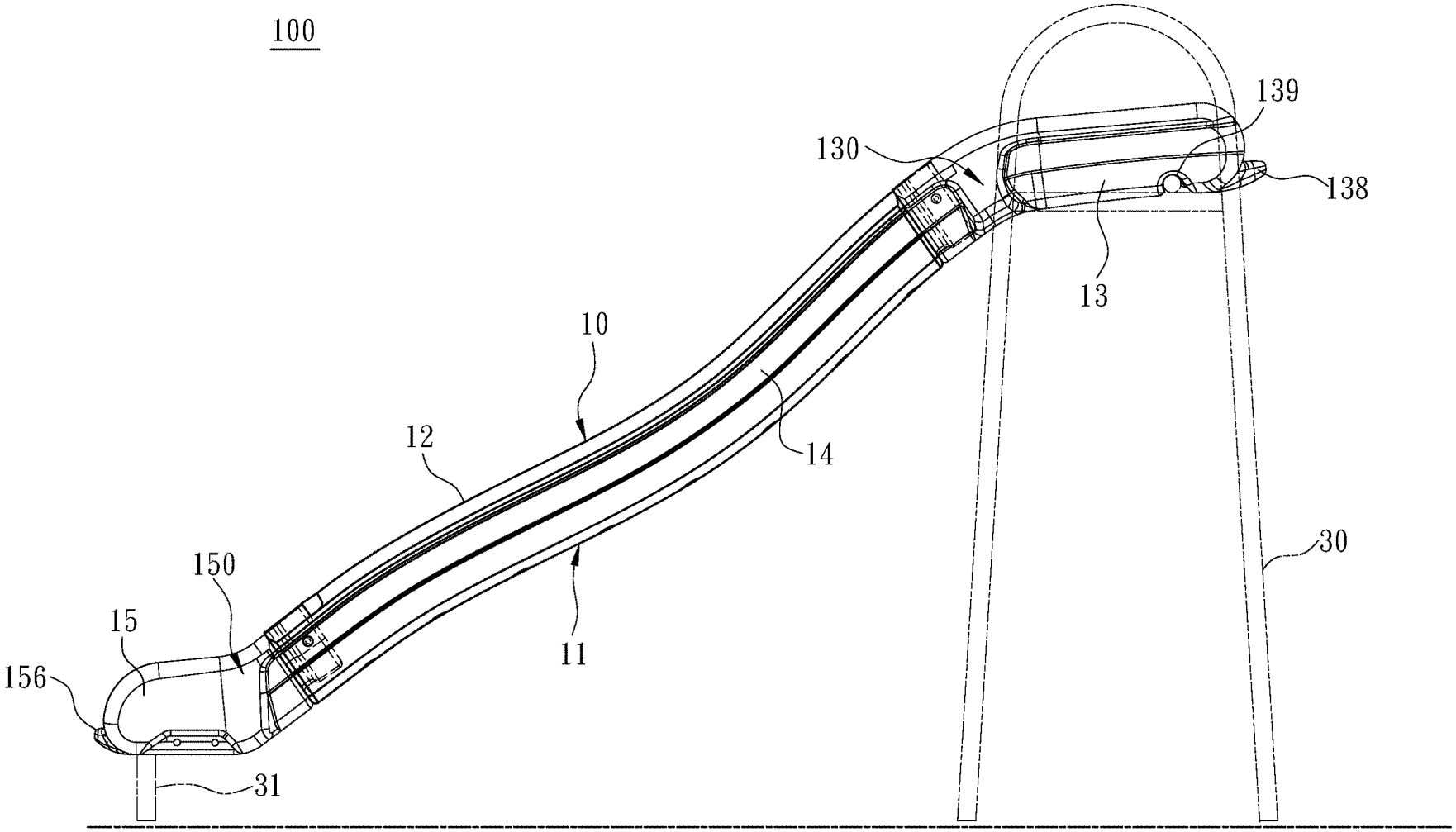
FIG. 1 is a schematic view of the implementation of an assembled slide according to an embodiment of the present invention.
Figure 2:
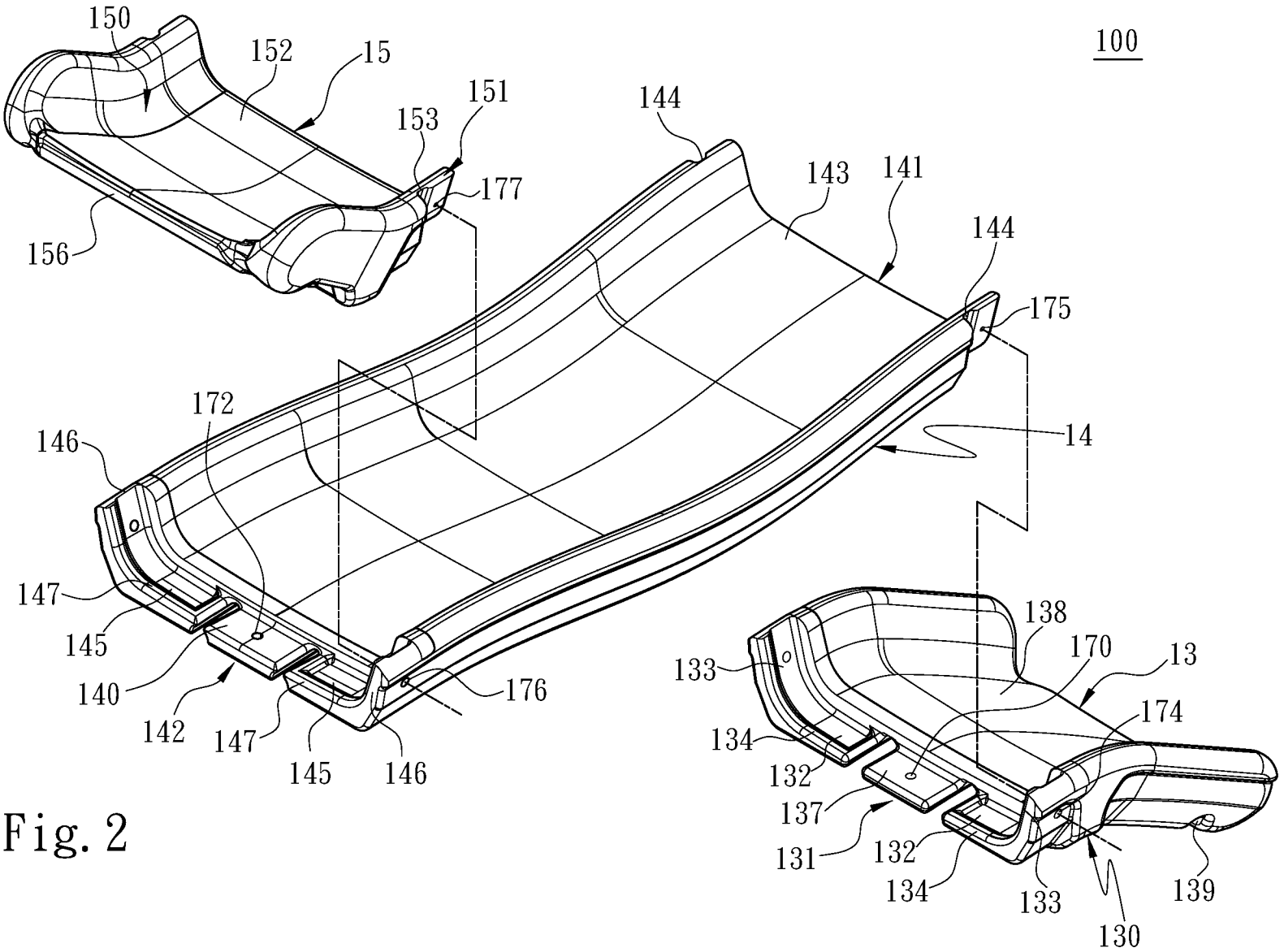
FIG. 2 is a first structural exploded view of the assembled slide according to an embodiment of the present invention.

The detailed description and technical content of the present invention will now be described with reference to the accompanying drawings as follows:

Referring to FIG. 1, FIG. 2, FIG. 3, FIG. 4, FIG. 5 and FIG. 6, the present invention provides an assembled slide 100 that can be implemented with a support frame 30 (or 31) or built on a children's play equipment according to requirements. The children's play equipment can be a swing, a toy house, and the like. The assembled slide 100 of the present invention is defined with a slide front side 10 for a user to slide on and a slide back side 11. Two sides of the slide front side 10 are respectively provided with a retaining wall 12. The user can slide between an area defined by the two retaining walls 12. Further, the assembled slide 100 comprises a head section 13, a connect section 14 and a tail section 15 which are assembled in sequence. The head section 13, the connect section 14 and the tail section 15 are independent components when not assembled. Each of the head section 13 and the tail section 15 comprises a turning portion (130, 150). When the assembled slide 100 is implemented, the connect section 14 is disposed slopingly on the head section 13 and the tail section 15 through the turning portions (130, 150). Furthermore, the head section 13 is provided for the user to sit on to prepare for sliding, while the tail section 15 is used to support on the ground. Further, the connect section 14 is a wavy structure or other linear structures depending on the implementation requirements. In addition, in one embodiment, a total length of the head section 13 and the tail section 15 is smaller than a length of the connect section 14, and the length of the connect section 14 does not exceed two times the total length of the head section 13 and the tail section 15.

Additionally, the head section 13 of the present invention is disposed with a first carrying portion 131 at a head section first end facing the connect section 14, the connect section 14 is disposed with a first lapping portion 141 connected to the first carrying portion 131 at a connect section first end facing the head section 13, the connect section 14 is disposed with a second carrying portion 142 at a connect section second end facing the tail section 15, and the tail section 15 is disposed with a second lapping portion 151 connected to the second carrying portion 142 at a tail section first end facing the connect section 14. Further, when the assembled slide 100 is implemented, the head section 13 is located at a high position relative to the tail section 15, and the first carrying portion 131 is placed below the first lapping portion 141 when assembled, so that the head section 13 and the connect section 14 are lapped to obtain a better assembly strength. Furthermore, the connect section 14 and the tail section 15 of the present invention are also assembled by using lap joint, that is, the second carrying portion 142 is placed below the second lapping portion 151 when assembled. Further, in one embodiment, the first carrying portion 131 comprises two first connect plates 132 respectively located at two sides of the head section first end, two first connect walls 133 respectively extending from one of the first connect plates 132 and serving as a part of one of the retaining walls 12, and two first protrusions 134 respectively disposed on one of the first connect plates 132 and extending to one of the first connect walls 133. Wherein the first connect plates 132 are disposed separately. Furthermore, the first lapping portion 141 comprises a second connect plate 143 connected to the two first connect plates 132, and two first grooves 144 disposed on the second connect plate 143 and respectively assembled to one of the first protrusions 134. The first protrusions 134 and the first grooves 144 are designed to achieve a corresponding structure of lap joint. In addition, in one embodiment, the second carrying portion 142 comprises two third connect plates 145 respectively located at two sides of the connect section second end, two second connect walls 146 respectively extending from one of the third connect plates 145 and serving as a part of one of the retaining walls 12, and two second protrusions 147 respectively disposed on one of the third connect plates 145 and extending to one of the second connect walls 146. Wherein the third connect plates 145 are disposed separately. In addition, the second lapping portion 151 comprises a fourth connect plate 152 connected to the two third connect plates 145, and two second grooves 153 disposed on the fourth connect plate 152 and respectively assembled to one of the second protrusions 147. Furthermore, the second protrusions 147 and the second grooves 153 are designed to achieve a corresponding structure of lap joint.

Figure 3:
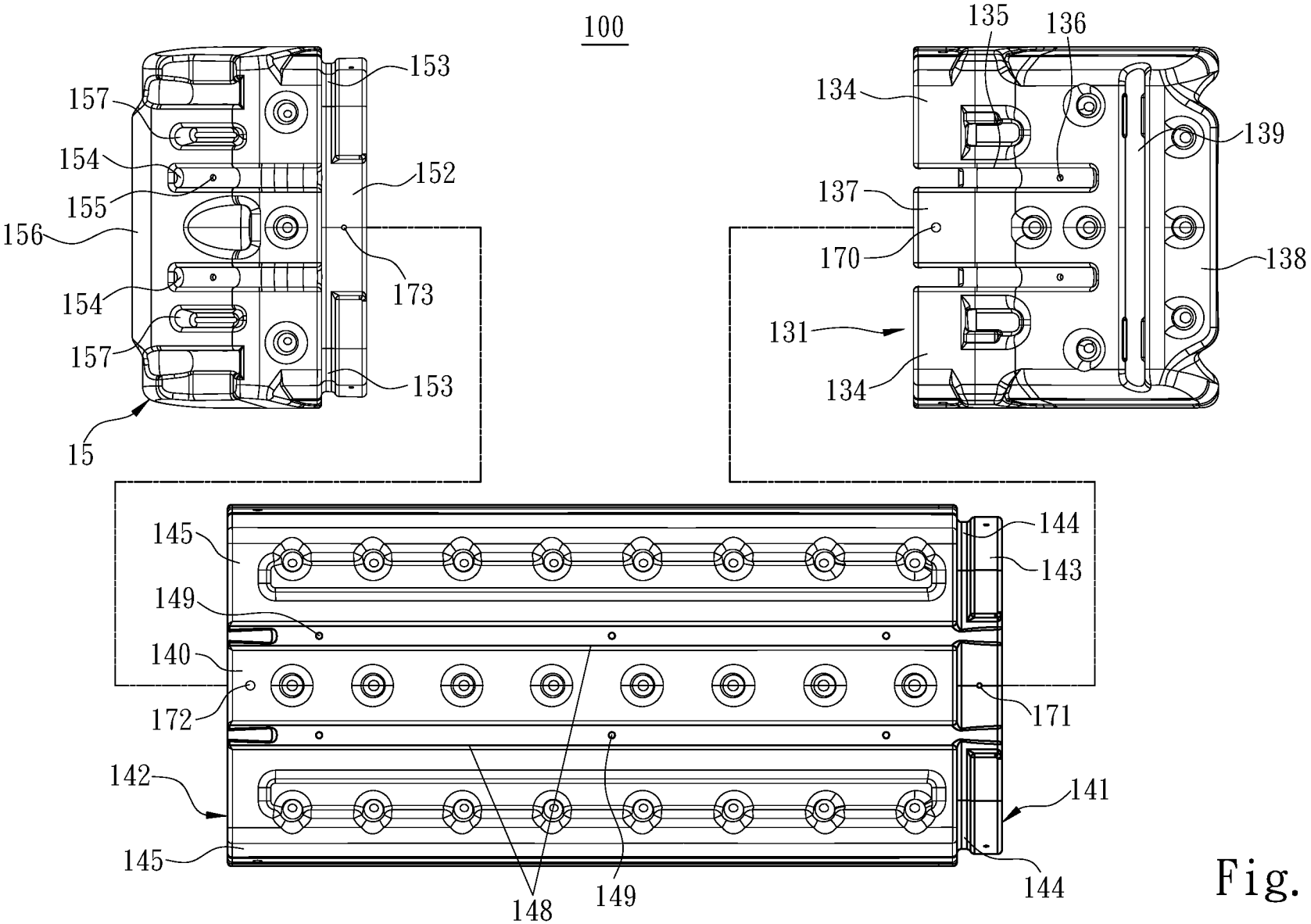
FIG. 3 is a second structural exploded view of the assembled slide according to an embodiment of the present invention.
Figure 4:
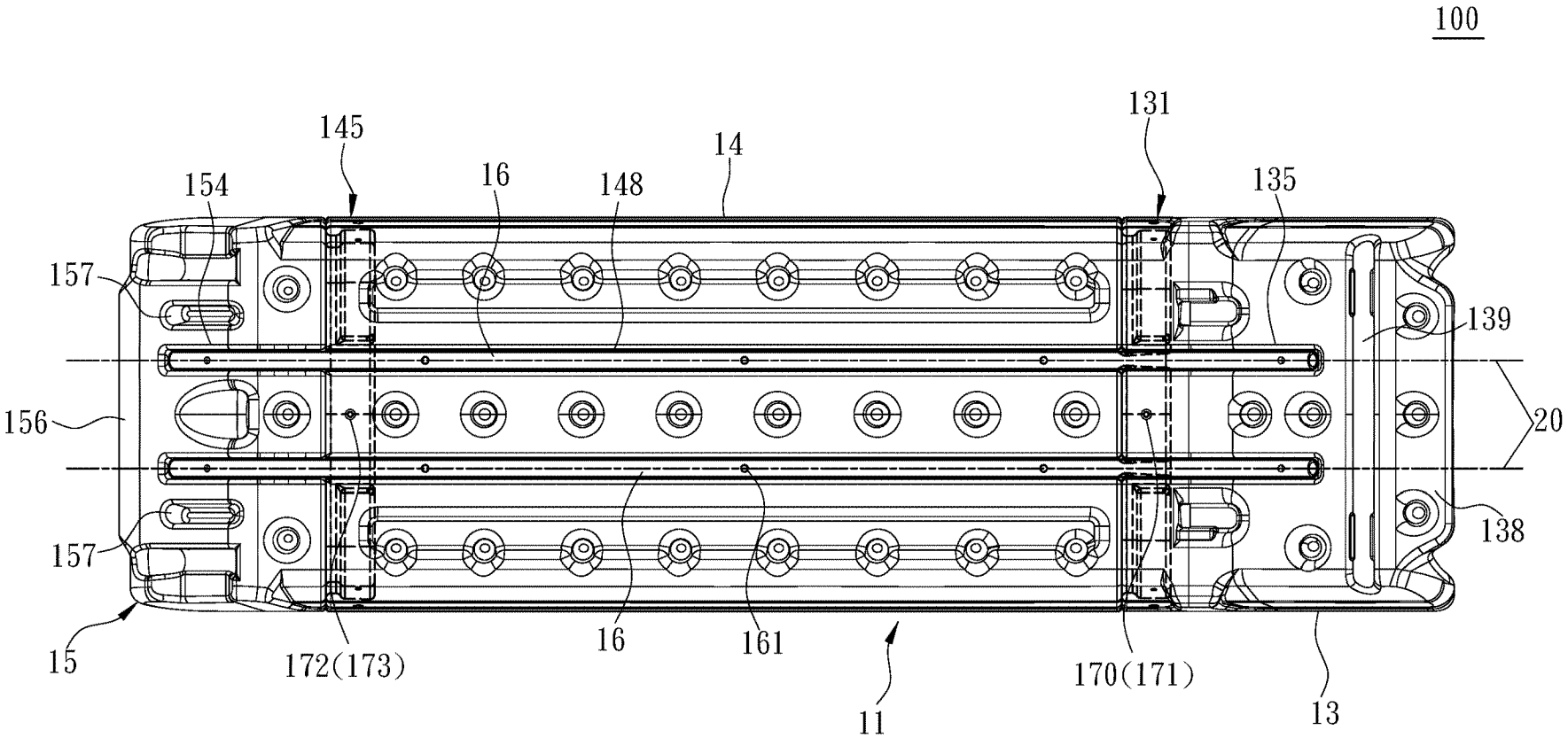
FIG. 4 is a schematic view of a slide back side of the assembled slide according to an embodiment of the present invention.
Figure 5:
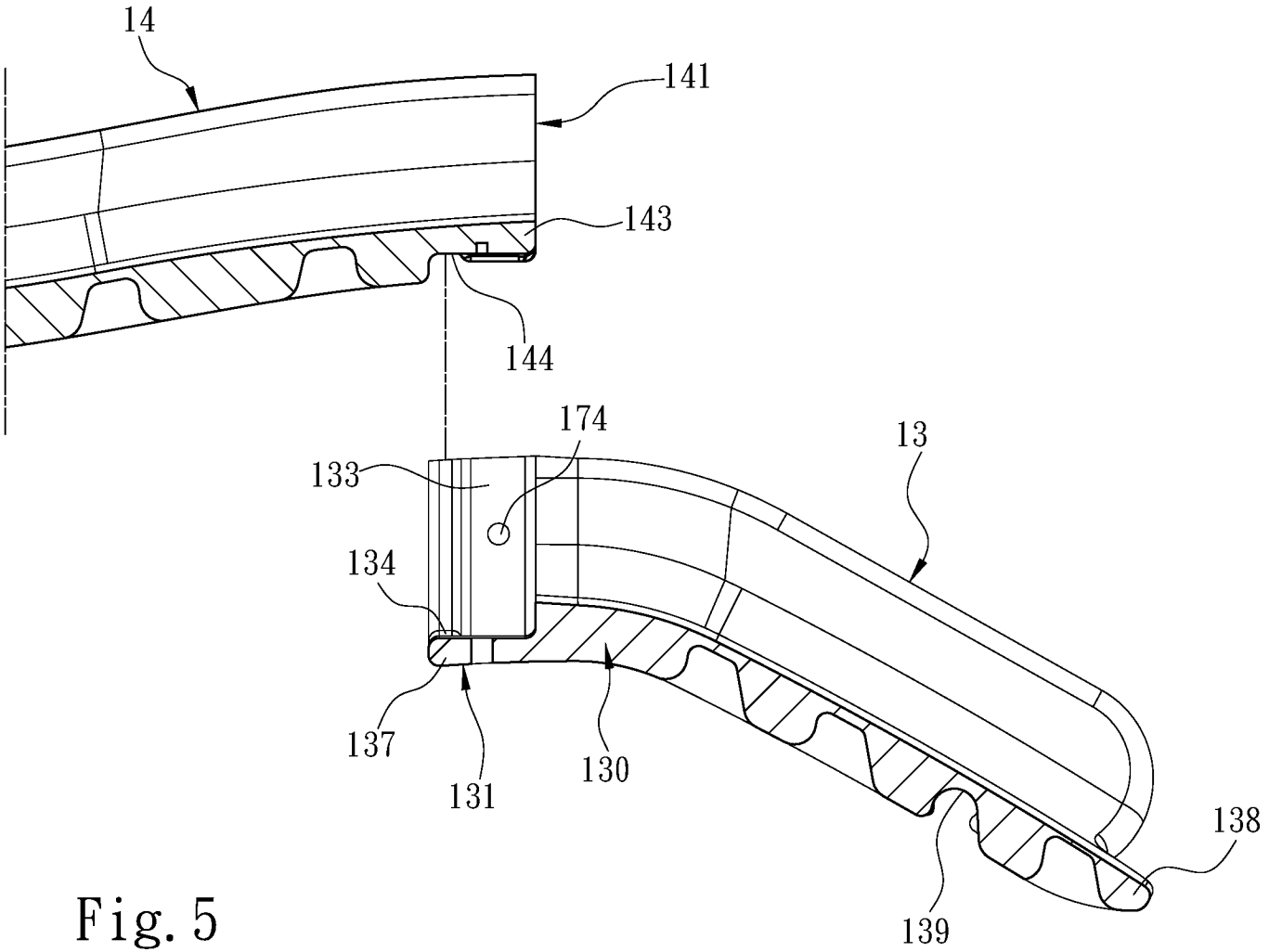
FIG. 5 is a cross-sectional view of the lap joint between a head section and a connect section according to an embodiment of the present invention.
Figure 6:
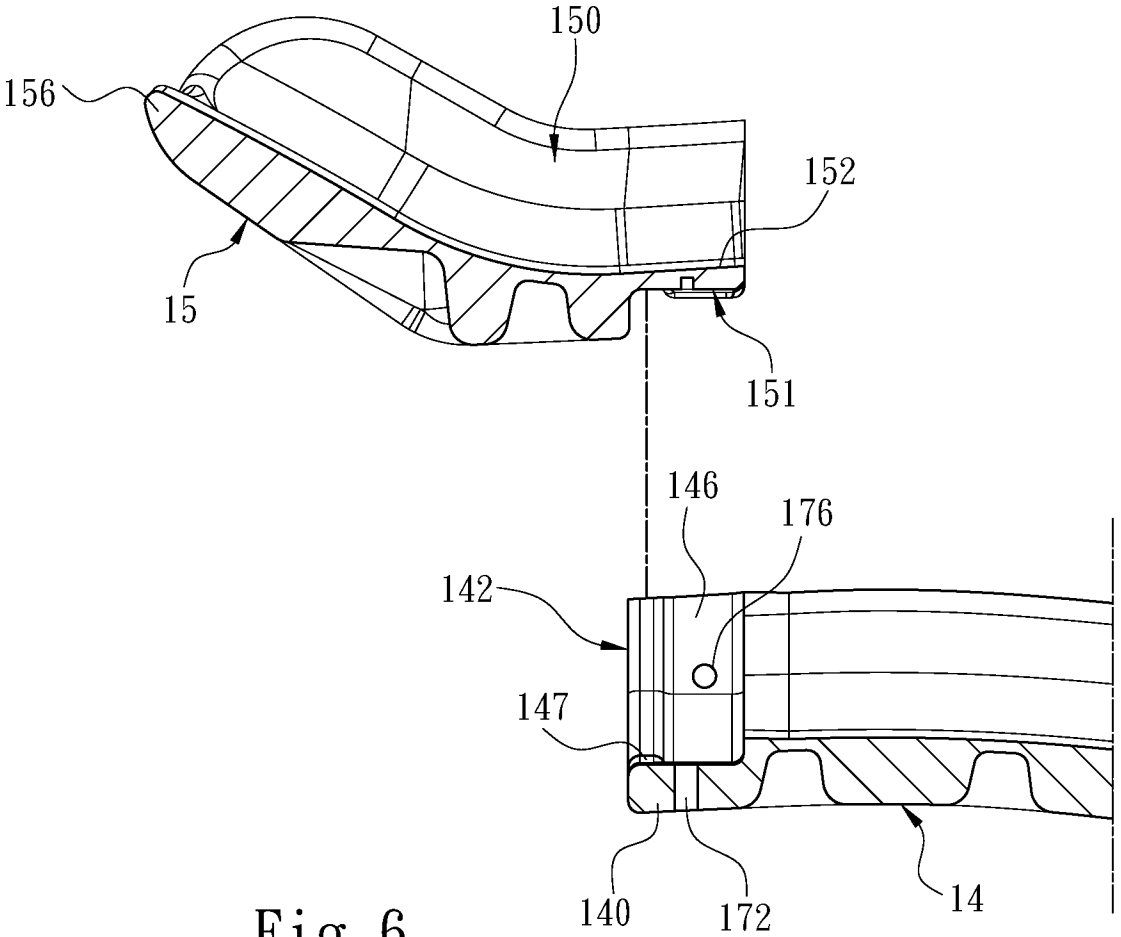
FIG. 6 is a cross-sectional view of the lap joint between the connect section and a tail section according to an embodiment of the present invention.

Referring to FIG. 3 and FIG. 4, the head section 13, the connect section 14 and the tail section 15 of the present invention are respectively further formed with at least one accommodating groove 135, 148, 154 on the slide back side 11, and the accommodating grooves 135, 148, and 154 are located on an axis 20 and are communicated sequentially; that is, after the assembled slide 100 is assembled, the accommodating grooves 135, 148, and 154 are communicated. Moreover, the accommodating grooves 135, 148, and 154 are recessed from the slide back side 11, but do not protrude from the slide front side 10, so that a part of the slide front side 10 for sliding is always smooth. Additionally, the accommodating groove 135 located in the head section 13 is formed at a flat and straight portion of the head section 13 relative to the connect section 14, and the accommodating groove 154 located in the tail section 15 is formed at a flat and straight portion of the tail section 15 relative to the connect section 14.

On the other hand, the assembled slide 100 further comprises at least one support rib 16 disposed in the accommodating grooves 135, 148 and 154. The support rib 16 is designed as a linear structure, and the support rib 16 can be implemented as a single rod or as an assembly of a plurality of rods. Moreover, the support rib 16 can be implemented as a round rod, and groove bottoms of the accommodating grooves 135, 148, and 154 can be respectively structured arcuately to increase contact areas between the support rib 16 and the accommodating grooves 135, 148, and 154 in order to enhance the structural stability. Furthermore, the head section 13, the connect section 14 and the tail section 15 respectively comprise at least one first fixing hole 136, 149, 155 disposed in the accommodating groove 135, 148, 154, and the support rib 16 is disposed with a plurality of second fixing holes 161. When the support rib 16 is placed in the accommodating grooves 135, 148, and 154, each of the second fixing holes 161 faces one of the first fixing holes 136, 149 and 155 respectively, and a fixing member is provided to pass through each of the second fixing holes 161 and one of the first fixing holes 136, 149 and 155 respectively, so that the support rib 16 is fixed. Therefore, the support rib 16 of the present invention is not assembled with another support rod after the assembled slide 100 is assembled.

In addition to the foregoing, the present invention can be implemented with at least two of the support ribs 16, and the head section 13, the connect section 14 and the tail section 15 are respectively formed with a same quantity of the accommodating grooves 135, 148, and 154 as a quantity of the support ribs 16. Further, the accommodating grooves 135, 148, and 154 are respectively located on at least two of the axes 20 which are parallel to each other, as shown in FIG. 4. Each of the support ribs 16 is located on one of the axes 20 during assembly. Further, each of the support ribs 16 can be completely placed into the accommodating grooves 135, 148, and 154 during assembly, so that the assembled slide 100 does not have protrusions on the slide back side 11 caused by the support ribs 16.

Referring to FIG. 2, FIG. 3, FIG. 4, FIG. 5 and FIG. 6, based on the previous embodiments, besides comprising the two first connect plates 132 and the two first connect walls 133, the first carrying portion 131 further comprises a first auxiliary support plate 137 separated from the two first connect plates 132 and located between the two axes 20. The second connect plate 143 is disposed on the first auxiliary support plate 137 during assembly. Moreover, the first auxiliary support plate 137 and a portion of the second connect plate 143 corresponding to the first auxiliary support plate 137 can be disposed with a concavo-convex structure according to the implementation requirements to increase the structural strength of the assembled slide 100. Furthermore, the first auxiliary support plate 137 is disposed with a first assemble and connect hole 170, the second connect plate 143 is disposed with a second assemble and connect hole 171 corresponding to the first assemble and connect hole 170. The first assemble and connect hole 170 as well as the second assemble and connect hole 171 can be disposed with a connecting member (not shown) therein to strengthen the connection between the head section 13 and the connect section 14. Further, the connecting member can be a screw or a plug pin or the like. Moreover, the second assemble and connect hole 171 does not penetrate through the second connect plate 143 at the slide front side 10, that is, the connecting member does not protrude from the slide front side 10. In addition, besides comprising the two third connect plates 145 and the two second connect walls 146, the second carrying portion 142 further comprises a second auxiliary support plate 140 separated from the two third connect plates 145 and located between the two axes 20. The fourth connect plate 152 is disposed on the second auxiliary support plate 140 during assembly. Moreover, the second auxiliary support plate 140 and a portion of the fourth connect plate 152 corresponding to the second auxiliary support plate 140 can be disposed with a concavo-convex structure according to the implementation requirements. Furthermore, the second auxiliary support plate 140 is disposed with a third assemble and connect hole 172, the fourth connect plate 152 is disposed with a fourth assemble and connect hole 173 corresponding to the third assemble and connect hole 172. The third assemble and connect hole 172 as well as the fourth assemble and connect hole 173 can be disposed with another connecting member (not shown) therein to strengthen the connection between the connect section 14 and the tail section 15. Moreover, the fourth assemble and connect hole 173 does not penetrate through the fourth connect plate 152 at the slide front side 10, that is, the connecting member does not protrude from the slide front side 10. In addition, the first carrying portion 131 and the first lapping portion 141 can also be disposed with at least one fifth assemble and connect hole 174 and at least one sixth assemble and connect hole 175 at appropriate positions for assembling. On the other hand, the second carrying portion 142 and the second lapping portion 151 can also be disposed with at least one seventh assemble and connect hole 176 and at least one eighth assemble and connect hole 177 at appropriate positions for assembling.

Referring to FIG. 1, in one embodiment, the head section 13 comprises a first engaging tab 138 disposed at a head section second end opposite to the connect section 14. The first engaging tab 138 is disposed at a position where the assembled slide 100 is engaged with the children's play equipment to increase the safety of recreation. Furthermore, the tail section 15 comprises a second engaging tab 156 disposed at a tail section second end opposite to the connect section 14. The second engaging tab 156 can ease off a drop between the tail section 15 and the ground, thereby increasing the safety of recreation. In addition, referring to FIG. 1 and FIG. 3, in one embodiment, at least one of the head section 13 and the tail section 15 is formed with at least one support frame mounting groove 139 (or 157) on the slide back side 11, and the support frame mounting groove 139 (or 157) is provided for a support element or the support frame 30 (or 31) to dispose therein.

What is claimed is:

1. An assembled slide, defined with a slide front side and a slide back side, two sides of the slide front side respectively disposed with a retaining wall, characterized in that:

the assembled slide comprises a head section, a connect section and a tail section which are assembled in sequence, the head section is disposed with a first carrying portion at a head section first end facing the connect section, the connect section is disposed with a first lapping portion connected to the first carrying portion at a connect section first end facing the head section, the connect section is disposed with a second carrying portion at a connect section second end facing the tail section, and the tail section is disposed with a second lapping portion connected to the second carrying portion at a tail section first end facing the connect section, the head section, the connect section and the tail section are respectively formed with at least one accommodating groove on the slide back side, the accommodating grooves are located on an axis and are communicated sequentially, and the assembled slide comprises at least one support rib disposed in the accommodating grooves.

2. The assembled slide as claimed in claim 1, wherein the accommodating grooves are respectively located on at least two axes which are parallel to each other, the assembled slide has at least two support ribs, and each of the at least two support ribs is located on one of the at least two axes.

3. The assembled slide as claimed in claim 2, wherein the first carrying portion comprises two first connect plates respectively located at two sides of the head section first end, a first auxiliary support plate separated from the two first connect plates and located between the at least two axes, two first connect walls respectively extending from one of the first connect plates and serving as a part of one of the retaining walls, and two first protrusions respectively disposed on one of the first connect plates and extending to one of the first connect walls, the first lapping portion comprises a second connect plate connected to the two first connect plates and the first auxiliary support plate, and two first grooves disposed on the second connect plate and respectively assembled to one of the first protrusions.

4. The assembled slide as claimed in claim 3, wherein the second carrying portion comprises two third connect plates respectively located at two sides of the connect section second end, a second auxiliary support plate separated from the two third connect plates and located between the at least two axes, two second connect walls respectively extending from one of the third connect plates and serving as a part of one of the retaining walls, and two second protrusions respectively disposed on one of the third connect plates and extending to one of the second connect walls, the second lapping portion comprises a fourth connect plate connected to the two third connect plates and the second auxiliary support plate, and two second grooves disposed on the fourth connect plate and respectively assembled to one of the second protrusions.

5. The assembled slide as claimed in claim 1, wherein at least one of the head section and the tail section is formed with at least one support frame mounting groove on the slide back side.

6. The assembled slide as claimed in claim 1, wherein the first carrying portion comprises two first connect plates respectively located at two sides of the head section first end, two first connect walls respectively extending from one of the first connect plates and serving as a part of one of the retaining walls, and two first protrusions respectively disposed on one of the first connect plates and extending to one of the first connect walls, the first lapping portion comprises a second connect plate connected to the two first connect plates, and two first grooves disposed on the second connect plate and respectively assembled to one of the first protrusions.

7. The assembled slide as claimed in claim 6, wherein the second carrying portion comprises two third connect plates respectively located at two sides of the connect section second end, two second connect walls respectively extending from one of the third connect plates and serving as a part of one of the retaining walls, and two second protrusions respectively disposed on one of the third connect plates and extending to one of the second connect walls, the second lapping portion comprises a fourth connect plate connected to the two third connect plates, and two second grooves disposed on the fourth connect plate and respectively assembled to one of the second protrusions.

8. The assembled slide as claimed in claim 1, wherein the second carrying portion comprises two third connect plates respectively located at two sides of the connect section second end, two second connect walls respectively extending from one of the third connect plates and serving as a part of one of the retaining walls, and two second protrusions respectively disposed on one of the third connect plates and extending to one of the second connect walls, the second lapping portion comprises a fourth connect plate connected to the two third connect plates, and two second grooves disposed on the fourth connect plate and respectively assembled to one of the second protrusions.

9. The assembled slide as claimed in claim 1, wherein the head section comprises a first engaging tab disposed at a head section second end opposite to the connect section, and the tail section comprises a second engaging tab disposed at a tail section second end opposite to the connect section.

* * * * *